United States Patent [19]

Kim

[11] Patent Number: 4,935,948

[45] Date of Patent: Jun. 19, 1990

[54] X-RAY TUBE NOISE REDUCTION BY MOUNTING A RING MASS

[75] Inventor: Jeung T. Kim, Schenectady, N.Y.

[73] Assignee: General Electric Company, Schenectady, N.Y.

[21] Appl. No.: 282,783

[22] Filed: Dec. 12, 1988

[51] Int. Cl.[5] ..... H01J 35/10

[52] U.S. Cl. ..... 378/125; 378/132

[58] Field of Search ..... 378/132, 133, 125, 131

[56] References Cited

U.S. PATENT DOCUMENTS 3,855,492 12/1974 Langer et al. ..... 378/125

*Primary Examiner*—Craig E. Church

*Attorney, Agent, or Firm*—Paul R. Webb, II; James C. Davis, Jr.

[57] ABSTRACT

An arrangement for reducing noise in an X-ray tube uses a ring mass disposed on the bearing shroud. The ring mass dissipates vibrational energy which would otherwise be transmitted to the glass envelope of the vacuum tube within the casing of the X-ray tube. The ring mass, which is tightly coupled to the bearing shroud, is mounted adjacent the neck of the glass envelope of the vacuum tube. The ring mass is made of lead and may have two ends at a split so that a bolt may tighten the ring around the bearing shroud.

20 Claims, 8 Drawing Sheets

WITHOUT MASS: 74dB

2lb MASS: 65.4dB

X-RAY TUBE NOISE REDUCTION BY MOUNTING A RING MASS

BACKGROUND OF THE INVENTION

This invention relates to X-ray tubes. More specifically, this invention relates to a noise reduction system or technique for an X-ray tube.

The use of X-ray tubes is quite common. Such X-ray tubes have many uses, one of the most common being as a medical tool. The X-ray system allows a doctor to view features within a patient.

Unfortunately, an X-ray tube operating at steady state condition generates significant noise. The sound pressure level may vary from one X-ray tube design tube to another, but is often about 78 to 80 dB for X-ray systems commonly used in the medical environment. At that level of sound, communication between a patient and doctor is difficult.

An X-ray tube has a vacuum tube mounted in it. The vacuum tube includes an electron emitter which supplies electrons to a target. The target is rotating so as to prevent it from burning out from the electrons supplied to it. The target is used to generate the X-ray radiation. The rotation of the target generates vibration which is transmitted through to the casing by various structural paths, the casing surrounding the vacuum tube and having oil disposed between the vacuum tube and the casing. The oil is used to dissipate heat generated by the vacuum tube and to serve as a dielectric. When the vibration source energy is received by the casing, the casing in turn radiates the sound. Unfortunately, the casing is very thick and has non-uniform spatial distribution so that the chances to reduce the sound radiation from the casing are quite restricted. Additionally, the strong coupling between various of the X-ray tube components hinders any attempt to prevent transmission of vibration energy through to the casing. For example, the oil for dielectric and cooling purposes has little or no attenuation of the vibration energy because the oil is basically incompressable. Also, the vacuum glass surrounding the vacuum tube is a lightweight material so that even a small amount of transmitted energy causes significant vibration of the glass.

As mentioned, the rotation of the target and associated components, more specifically bearings at opposite ends of a rotor shaft used to rotate the target, are responsible for the bearing vibration which leads to the noise. Although one might limit the noise by lowering the rotation speed, this would make it necessary to lower the power of the X-ray and/or lead to damage or shortened life expectancy of the rotating target. Therefore, the lowering of the rotation frequency may not be suitable unless one is willing to sacrifice the image quality.

OBJECTS AND SUMMARY OF THE INVENTION

Accordingly, it is a primary object of the present invention to provide a new and improved X-ray tube.

A more specific object of the present invention is to provide an X-ray tube having reduced noise.

Yet another object of the present invention is to improve the noise characteristics of an X-ray tube with a minimal number of additional parts beyond the standard X-ray tube and a minimum number of changes to previously used parts in an X-ray tube.

A still further object of the present invention is to provide X-ray tube noise reduction by an arrangement which may be assembled with few additional steps beyond those presently used for X-ray tube assembly.

The above and other objects of the present invention which will become more apparent as the description proceeds are realized by an X-ray tube having an outer casing. A vacuum tube is disposed within the outer casing. The vacuum tube has a glass envelope with an outwardly extending neck having a tip. The vacuum tube further includes a rotor shaft within the neck, and electron emitter within the glass envelope, a target within the envelope and connected for rotation by the rotor shaft, and an interface member at the tip. The interface member receives bearing vibration from rotation of the rotor shaft. A mass is mounted on the interface member and operable to receive and dissipate vibrational energy and minimize the transmission of vibrational energy to the glass envelope. The mass is a ring extending around the interface member. The interface member is a sleeve.

BRIEF DESCRIPTION OF THE DRAWINGS

The above and other features of the present invention will be more readily understood when the following detailed description is considered in conjunction with the accompanying drawings wherein like characters represent like parts throughout the several views and in which:

FIG. 7A shows a graph of a ratio representative of vibration response signals as measured by the arrangement of FIG. 5 and without using the present invention, whereas

FIG. 8A shows the noise for an X-ray tube not using the present invention, whereas

DETAILED DESCRIPTION

Figure 1:
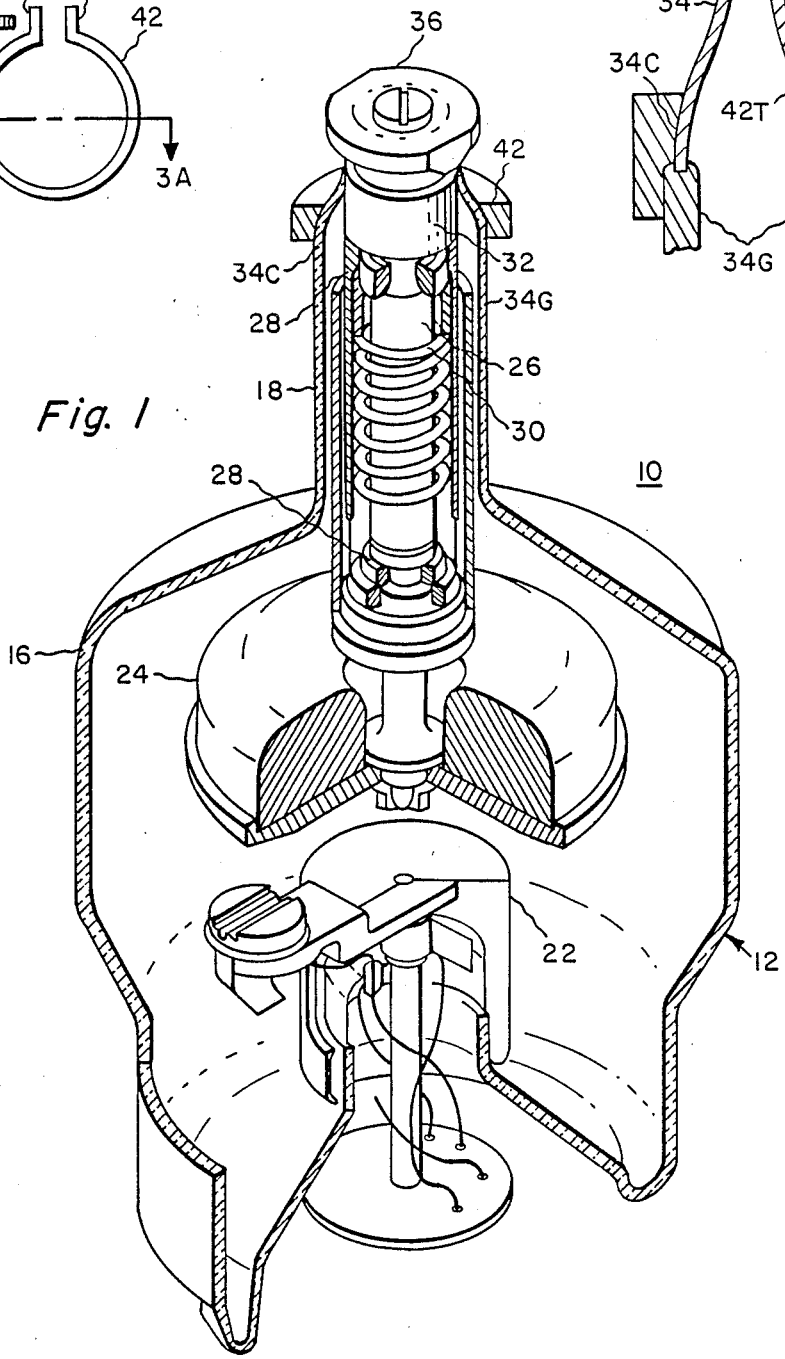
FIG. 1 shows a simplified perspective view of a portion of an X-ray tube according to the present invention with some parts shown in cross-section.
Figure 2:
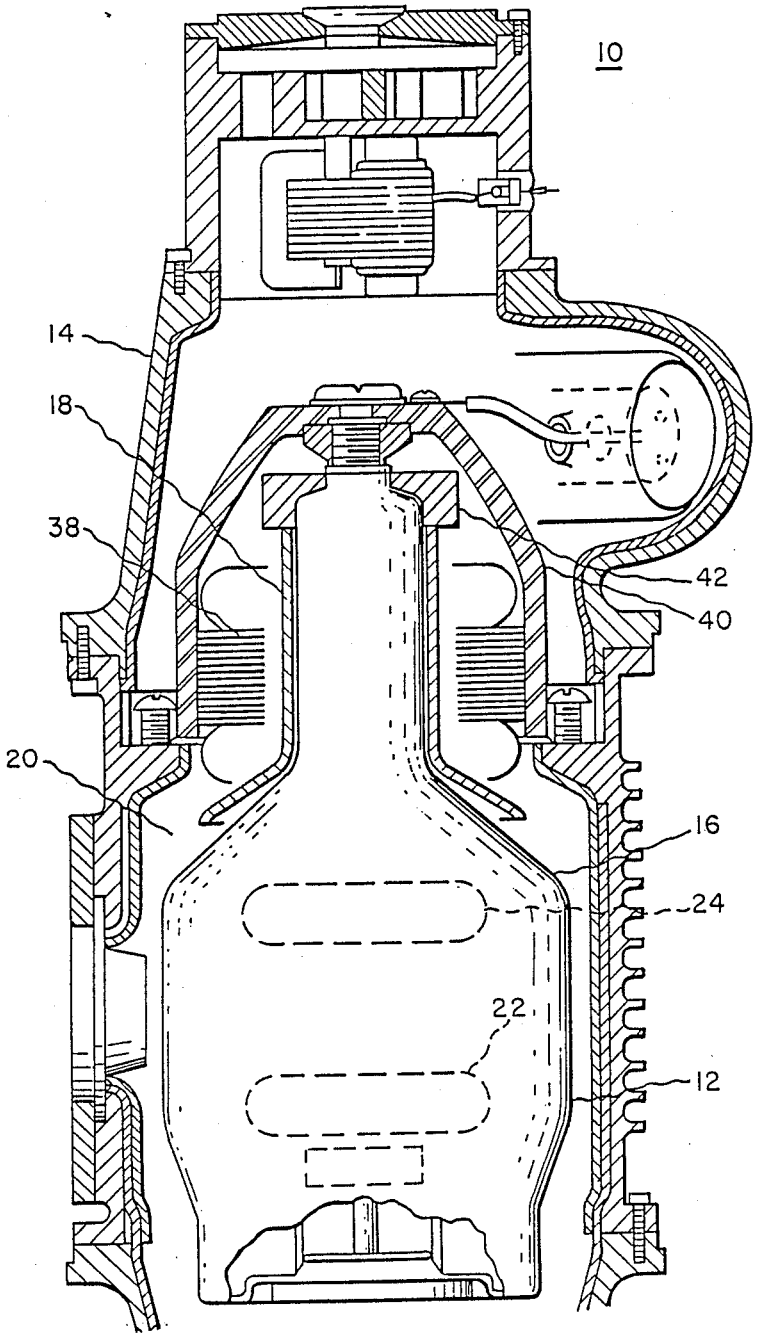
FIG. 2 shows a simplified side view cross-section of the tube with some parts shown schematically.

With reference now to FIGS. 1 and 2, an X-ray tube 10 includes a vacuum tube 12 disposed therein. For ease of illustration, FIG. 1 shows the vacuum tube 12, but does not show a casing 14 (shown in FIG. 2) which surrounds the vacuum tube 12. The vacuum tube 12 has a glass envelope 16 having a neck 18 disposed at one end thereof. Oil is used in chamber 20 in between the glass envelope 16 and the casing 14 for cooling the dielectric purposes.

Inside of the vacuum tube 12 is an electron emitter 22 and a target 24, both of which are illustrated schematically in FIG. 2. The electron emitter 22 emits electrons which strike the target 24 in order to generate X-ray energy in known fashion.

Concentrating on the view of FIG. 1, the target 24 is rotated by a rotor 26 having bearings 28 mounted at opposite ends thereof. A spring 30 is disposed in between the ball bearings 28 and a rotor base 32 is disposed at one end of the rotor 26. A bearing shroud or interface member 34 extends from the end of the glass neck 18 to the rotor base 32. The interface member or bearing shroud 34 is a sleeve which is somewhat conical in shape and would generally be a KOVOR sleeve. This shroud or sleeve 34 has thermal characteristics which reduce the chances that the diverse thermal characteristics of the base 32 and the glass neck 18 will cause cracking of the glass neck 18. A connecting piece 36 is disposed adjacent to the rotor base 32.

Referring now to FIG. 2, stator elements 38 are disposed around the glass neck 18 and serve to turn the rotor 26 (26 not shown in FIG. 2), thereby rotating the target 24. The stator elements 38 are within a basket 40 which generally surrounds the neck 18.

The parts of X-ray tube 10 which are discussed above are known structures except that the basket 40 of FIG. 2 is different than previously known baskets in a manner to be described in detail below. The operation of these previously described structures is well known and need not be described in great detail.

It should be noted that the primary noise source of the X-ray tube is the bearing vibration resulting from rotation of the target 24 and associated components. This vibration is transmitted through to the neck 18 primarily by way of the interface member 34 which is strongly coupled to the neck 18 and to the rotor base 32. 34G is the end section of glass tube neck.

With reference now to FIGS. 1 and 2, the arrangement of the present invention which is used to reduce X-ray tube noise will be described. In particular, a ring mass 42 is tightly clamped around the interface member 34. The ring mass 42 is tightly coupled around the bearing shroud 34. Momentarily referring to FIG. 3, the ring 42 may be a split ring having outwardly projecting flanges 44 with holes (not visible) disposed therein for receiving bolt 46. Bolt 46 may be used in combination with a nut (not shown) to tighten and split ring 42 around the bearing shroud 34. With reference to FIG. 3A, the ring 42 may be tightened around a conical or tapered portion 34T of the shroud 34, in which case a tapered inner surface 42T of the ring 42 conforms to portion 34T. Alternately, the ring 42 might be fastened around cylindrical, non-conical, portion 34C of the shroud 34. In either case, the bolt 46 may be used to tightly couple the ring 42 to the shroud 34. The ring contacts the sleeve or shroud 34 substantially continuously around the sleeve such that the ring is pressed radially outward by the bearing shroud. By having a taper on surface 42T to match (i.e., same angle) the taper on portion 34T, the coupling between ring 42 and shroud or sleeve 34 is maximized. A ring mass may extend to the end section of a glass tube.

Figure 3:
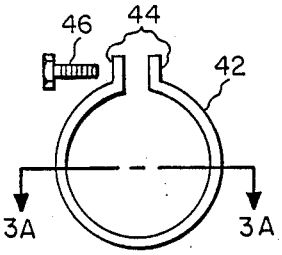
FIG. 3 shows a planar view of the ring mass of the present invention.
Figure 3A:
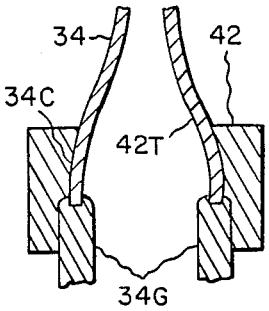
FIG. 3A is a cross-section view along lines 3A of FIG. 3 and showing the interface member and ring mass.

Although the view of FIG. 3 shows the flanges 44 projecting radially outwardly from the ring 42, the flanges 44 might alternately be disposed to project axially (i.e., parallel to the central axis or ring 42) relative to the circular portion of ring 42. In other words, in FIG. 3, the flanges 44 might project into or out of the plane of view. It should also be appreciated that arrangements other than the bolt 46 might be used for tightly coupling the ring 42 around the shroud or sleeve 34. For example, one might press-fit a ring mass around the sleeve 34 in which case the ring might constitute a closed loop (i.e., a ring without a split).

The ring 42 is made of lead and weighs about 2 lbs. However, other materials might be used and the weight could be between 1 lb. and 5 lbs.

As shown in FIG. 2, the basket 40 should be sufficiently large so that it may extend around the ring mass 42. This may require a slightly different and larger shape for the basket 40 than previously used. Whether the basket 40 needs to be reshaped and/or enlarged depends upon the volume of the ring mass 42.

Figure 4:
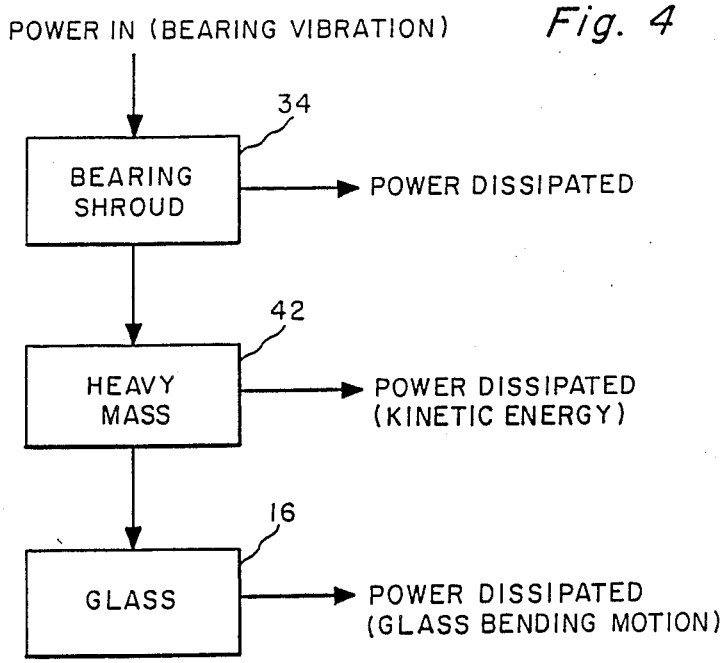
FIG. 4 shows a power flow diagram schematically representing the operation of the present invention.

With reference now to FIG. 4, the power flow realized by the present invention will be described. In particular, the bearing vibration is received by the bearing shroud or interface member 34 which dissipates some of the power. The vibrational energy is transmitted through to the ring mass 42 which serves to dissipate a further portion of the energy as kinetic energy. Accordingly, a smaller portion of the energy will be dissipated by the glass envelope 16 of the vacuum tube 12 (tube 12 not depicted in FIG. 4).

Figure 5:
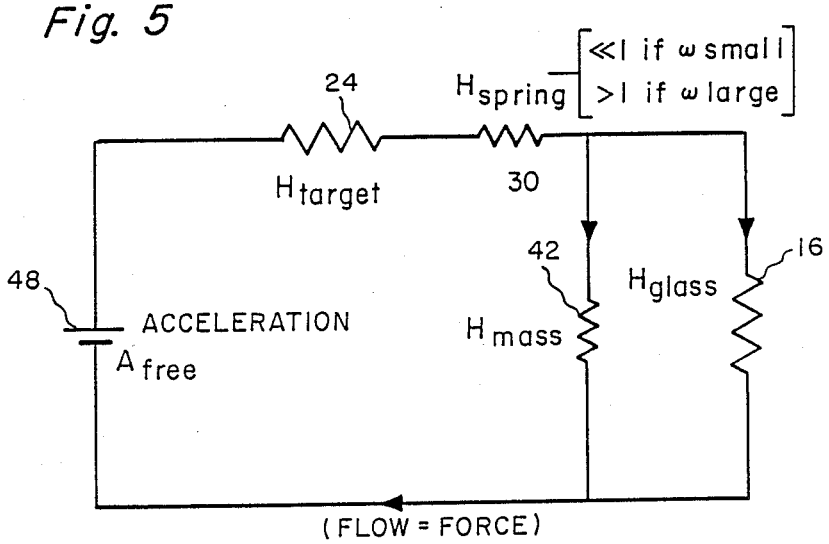
FIG. 5 shows an electrical circuit analogue to portions of the present invention.

With reference now to FIG. 5, a theory of operation with respect to the present invention will be discussed, it being readily understood that the applicant is not bound by any particular theory of operation. The acceleration of the target when no glass and mass are mounted is represented by $A_{free}$. This acceleration signal is equivalent to an applied voltage represented by battery 48 in FIG. 5. As the glass and mass are attached, the force (which is equivalent to current in the circuit flows in the system and the acceleration at the joint location becomes $A_{glass}$.

$H_{target}$, $H_{spring}$, $H_{mass}$, and $H_{glass}$ are the accelerance of target, joint stiffness, mass and glass. For simple calculation, let us assume:

$$H_{target} = \frac{1}{M_{target}}$$

$$H_{spring} = -\frac{W^2}{K}$$

$$H_{mass} = \frac{1}{M_{mass}}$$

$$H_{glass} = \frac{1}{8pkc_e h}$$

where $M_{target}$ is the mass of target, K is the spring constant of glass neck, w is a radial frequency, $M_{mass}$ is the mass of the added ring, p is the density of glass, k is the rigidity of glass, $c_e$ is the speed of sound in glass, h is the thickness of glass.

If there were not added mass, the glass acceleration from the circuit becomes:

$$A_{glass} = \frac{H_{glass}}{H_{target} + H_{spring} + H_{glass}} A_{free} \quad (1)$$

Here the spring is almost infinity and $H_{spring}$ is approximately 0. Also $H_{target}$ is much less than $H_{glass}$ for the current X-ray tube. Therefore, the $A_{glass}$ is approximately equal to $A_{free}$. This shows that glass vibration amplitude is about the same level of vibration source. There is no attenuation of bearing vibration.

Upon mounting of the ring mass 42, the circuit diagram of FIG. 5 shows that most of the force flows through the mass. Since mass accelerance $H_{mass}$ is significantly less than the glass accelerance the mass 42 works as a shunt element in the circuit and bypasses most of the incoming power. Therefore, the net amount of power flow which excites the glass 16 becomes small and the vibration amplitude of the glass is lower. This lowers the noise level of the X-ray tube.

Figure 6:
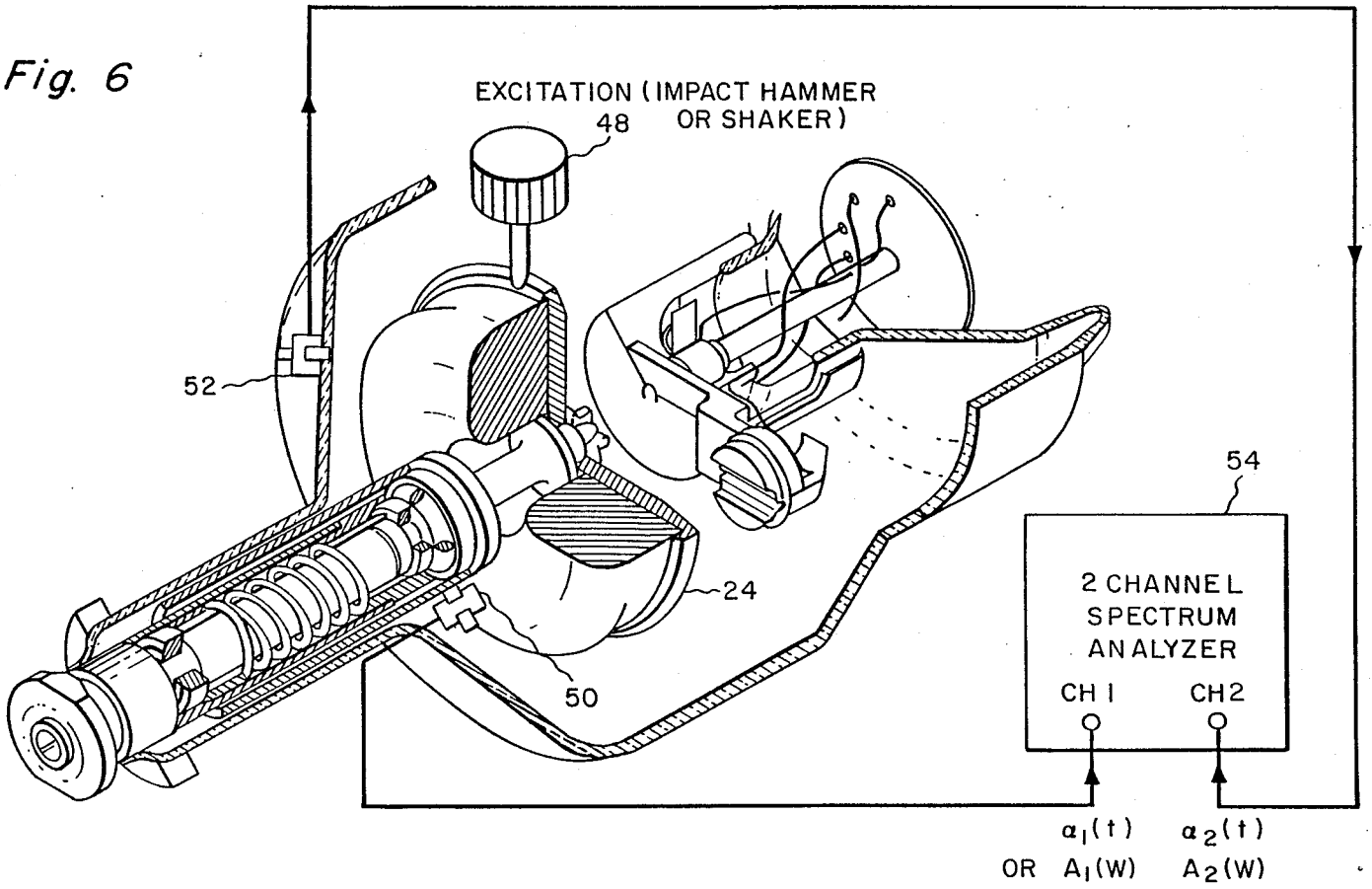
FIG. 6 shows a test measurement arrangement which has been used for measuring the noise reduction capability of the present invention.

An investigation of the effects of added mass was conducted using the measurement set-up of FIG. 6. In particular, a broadband vibration was applied to X-ray target 24 using a source 48. A first accelerator 50 was mounted on the target shaft, whereas a second accelerator 52 was mounted on the glass envelope. The signals from the accelerator were fed into a spectrum analyzer 54. The test was run with no added mass on the bearing shroud initially. The test was repeated with a C-clamp (0.5 kilograms, not shown) mounted to the bearing shroud as an added mass.

Figure 7A:
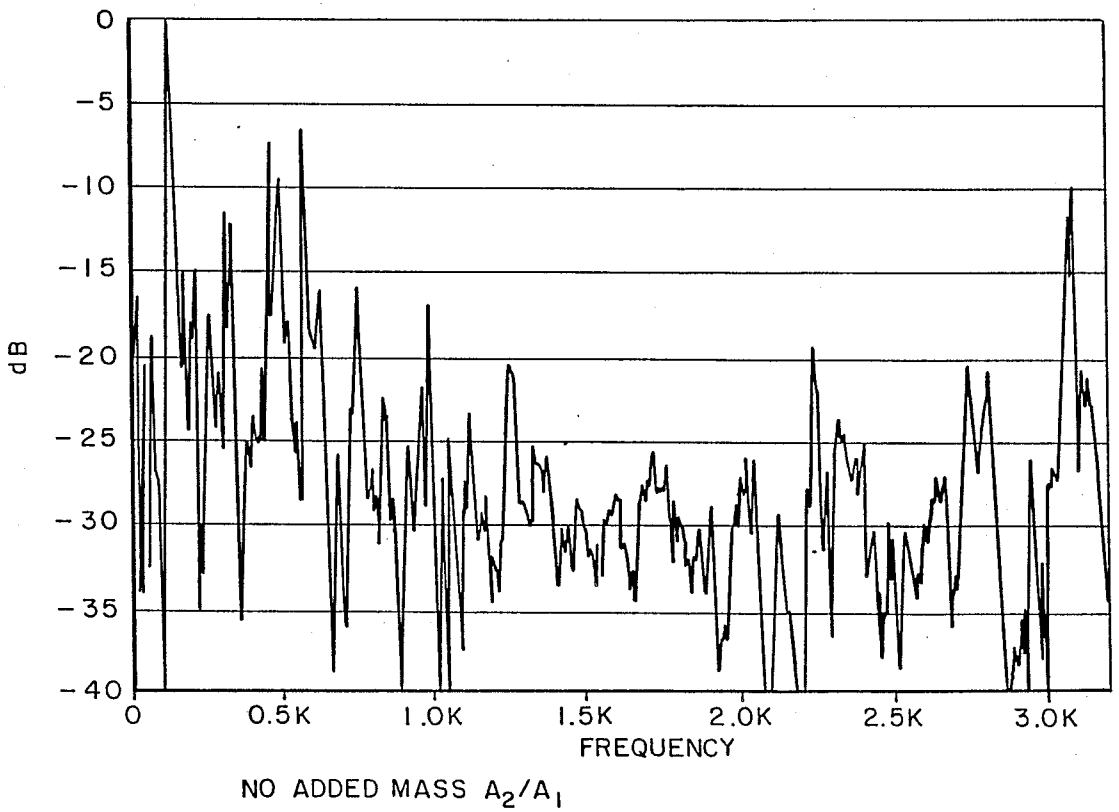
Figure 7B:
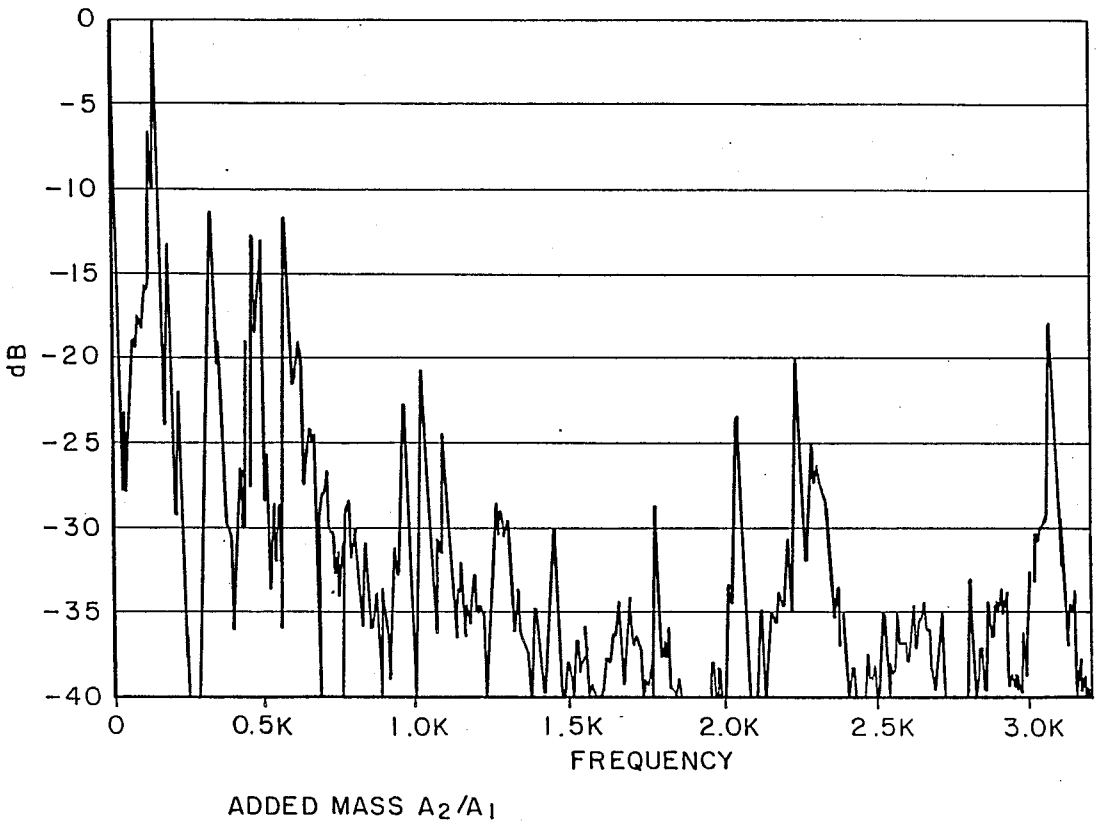
FIG. 7B shows a graph of the same ratio when the present invention is utilized and FIG. 7C shows the difference between the graphs of FIGS. 7A and 7B.

FIG. 7A shows the ratio of the signal from the second accelerometer to the signal from the accelerometer for no additional mass, whereas FIG. 7B shows the same ratio following the attachment of the C-clamp as an added mass. As a comparison between the two FIGS. shows, a significantly reduced portion of vibrational energy on the rotor shaft as sensed by accelerometer 50 is transmitted through to the glass envelope as sensed by accelerometer 52 upon the use of the added mass.

Figure 7C:
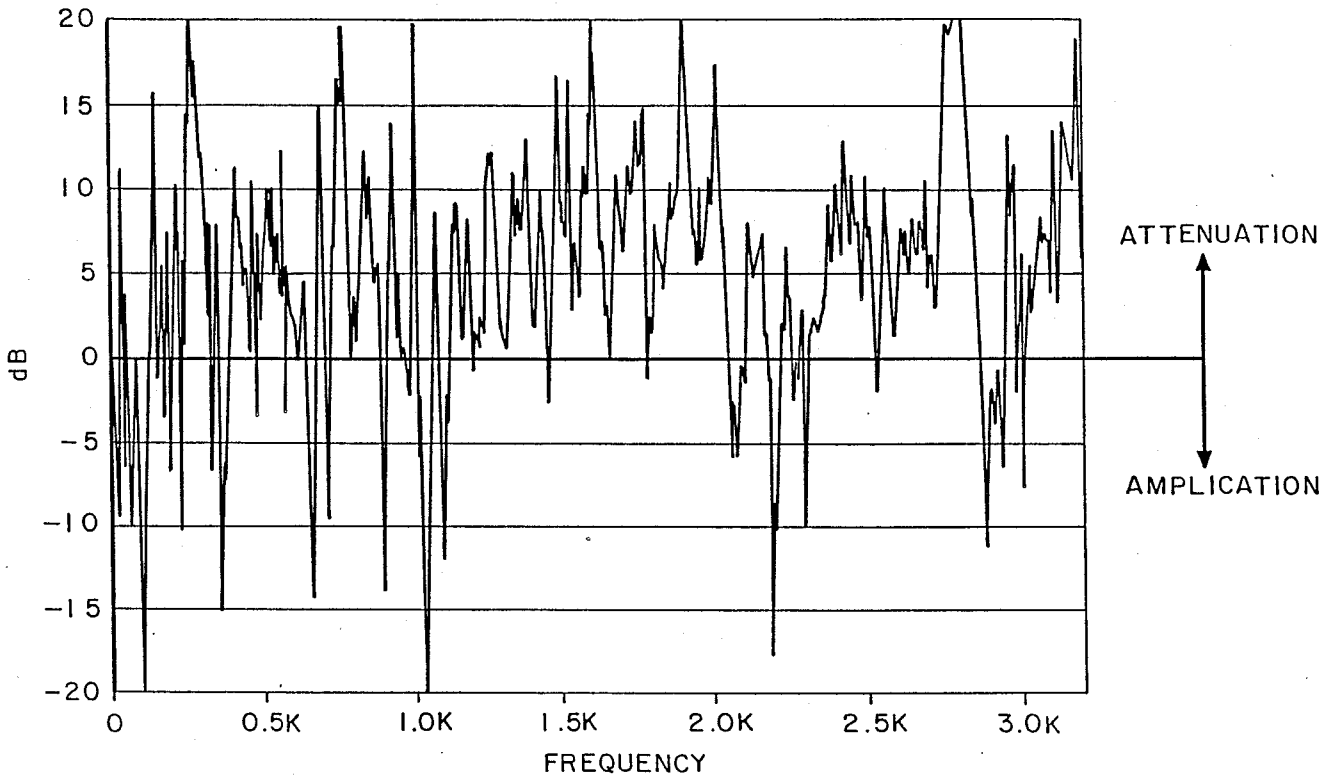

FIG. 7C shows the attenuation effect of the added mass. In particular, FIG. 7C shows the curve of FIG. 7B minus the curve of FIG. 7A. The presence of this difference curve of FIG. 7C above the 0 dB line indicates locations where the added mass has attenuated the vibrational energy.

Figure 8A:
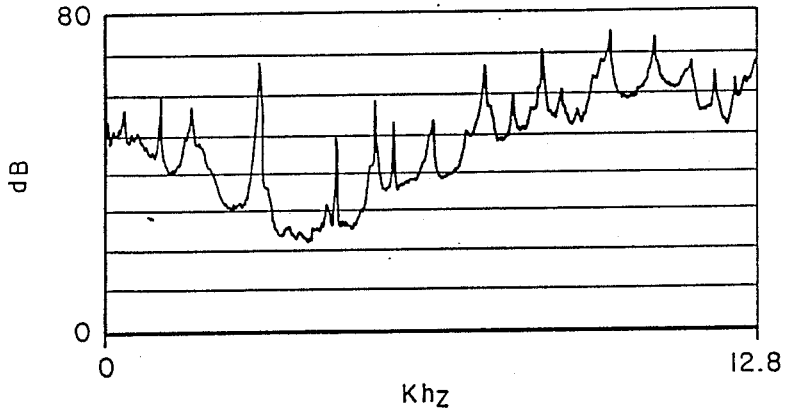
Figure 8B:
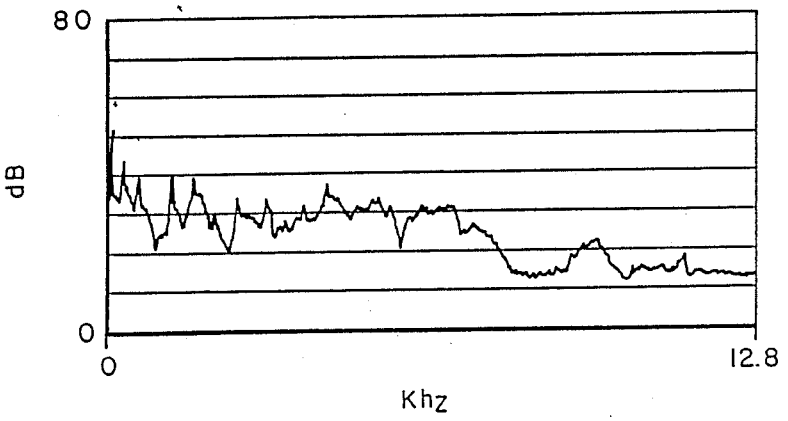
FIG. 8B shows the noise distribution for an X-ray tube using the present invention.

Whereas FIGS. 6, 7A, 7B, and 7C relate to measurement involved in a generally simulated arrangement, FIGS. 8A and 8B show results of actual noise tests upon an X-ray tube. In particular, FIG. 8A shows variations in the noise between 0 Hz and 12.8 kHz for an X-ray tube without a ring mass and with a reference of 20 micropascals. FIG. 8B shows the same data for an X-ray tube where a ring mass in accord with the present invention has been added. As indicated, the overall noise reduction was 8.6 dB.

Although various specific constructions and arrangements have been described herein, it is to be understood that these are for illustrative purposes only. Various modifications and adaptations will be apparent to those of skill in the art. Accordingly, the scope of the present invention should be determined by reference to the claims appended hereto.

What is claimed is:

1. An X-ray tube comprising:

an outer casing;

a vacuum tube within said outer casing, said vacuum tube having a glass envelope with an outwardly extending neck having a tip;

a rotor shaft within the neck and having bearings to rotatably support the rotor shaft; and electron transmitter within the glass envelope;

a target within the envelope and drivably connected for rotation by rotation of said rotor shaft;

an interface member at said tip, said interface member receiving bearing vibration from rotation of said rotor shaft; and a mass mounted on said interface member and operable to receive and dissipate vibrational energy and minimize the transmission of bearing vibration to said glass envelope.

2. The X-ray tube of claim 1 wherein said mass is a ring extending around said interface member.

3. The X-ray tube of claim 2 wherein said interface member is a sleeve and an end section of a glass neck.

4. The X-ray tube of claim 3 wherein said ring is a split ring tightened around said sleeve.

5. The X-ray tube of claim 4 wherein said sleeve is a bearing shroud having a tapered portion and said ring is mounted around and to said tapered portion.

6. The X-ray tube of claim 3 wherein said ring weighs between 1 lb. and 5 lbs.

7. The X-ray tube of claim 6 wherein said ring is made of lead.

8. The X-ray tube of claim 6 wherein said ring contacts said sleeve substantially continuously around said sleeve, said ring being pressed radially outward by said sleeve.

9. The X-ray tube of claim 8 wherein said ring is a split ring tightened around said sleeve.

10. The X-ray tube of claim 1 further comprising a stator around said rotor and outside of said neck, and a basket around said stator, and wherein said mass is within said basket.

11. The X-ray tube of claim 10 wherein said mass contacts said interface member substantially continuously around said interface member.

12. The X-ray tube of claim 11 wherein said interface member is a bearing shroud and said mass is mounted on said bearing shroud.

13. The X-ray tube of claim 12 wherein said mass weighs between 1 lb. and 5 lbs.

14. The X-ray tube of claim 12 wherein said mass is a ring and said ring is tightly coupled around said bearing shroud.

15. The X-ray tube of claim 14 wherein said ring is a split ring tightened around said bearing shroud.

16. The X-ray tube of claim 1 wherein said interface member is a bearing shroud and said mass is mounted on said bearing shroud.

17. The X-ray tube of claim 16 wherein said mass is a ring and said ring is tightly coupled around said bearing shroud.

18. The X-ray tube of claim 17 wherein said mass is made of lead.

19. The X-ray tube of claim 17 wherein said mass weighs between 1 lb. and 5 lbs.

20. The X-ray tube of claim 16 wherein said bearing shroud has a tapered portion and said mass is a ring having a tapered inner surface, said tapered inner surface of said ring positioned to bear against said tapered portion of said bearing shroud.

* * * * *